US006485675B1

(12) United States Patent
Becker et al.

(10) Patent No.: US 6,485,675 B1
(45) Date of Patent: Nov. 26, 2002

(54) BOTTOM FOR A METALLURGICAL VESSEL WITH A DIRECT CURRENT ELECTRIC ARC DEVICE

(75) Inventors: Lutz Becker, Duisburg (DE); Konrad Friebe, Duisburg (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/647,208

(22) PCT Filed: Mar. 3, 1999

(86) PCT No.: PCT/DE99/00631

§ 371 (c)(1),
(2), (4) Date: Nov. 28, 2000

(87) PCT Pub. No.: WO99/51065

PCT Pub. Date: Oct. 7, 1999

(30) Foreign Application Priority Data

Mar. 27, 1998 (DE) ..... 198 15 154

(51) Int. Cl.[7] ..... H05B 7/02; F27D 11/10

(52) U.S. Cl. ..... 266/242; 266/200; 266/286; 373/72

(58) Field of Search ..... 373/72, 95; 266/286, 266/280, 242, 200

(56) References Cited

U.S. PATENT DOCUMENTS 4,685,112 A * 8/1987 Michelet et al. ..... 373/72
5,588,018 A * 12/1996 Destannes ..... 373/72

* cited by examiner

*Primary Examiner*—Scott Kastler
(74) *Attorney, Agent, or Firm*—Cohen, Pontani, Lieberman & Pavane

(57) ABSTRACT

A base of a metallurgical vessel having a direct-current arc device whose cathode projects into the vessel and in whose fire-resistant lining on the base at least one anode is arranged, one end of which, passing through the vessel wall, touches metallic melt located in the vessel, and the other end of which can be connected to cooling fluid supply sources and is attached in an electrically insulated manner to the vessel wall via holding elements. A sleeve is provided which does not conduct electric current, sheaths that part of the anode which projects into the metallurgical vessel and, in the process of forming an outlet channel, is arranged at a distance sufficiently far away from the anode that low-melting-point metals, mainly lead, can flow out of the vessel without being impeded.

8 Claims, 1 Drawing Sheet

BOTTOM FOR A METALLURGICAL VESSEL WITH A DIRECT CURRENT ELECTRIC ARC DEVICE

PRIORITY CLAIM

This is a U.S. national stage of application No. PCT/DE99/00631, filed on Mar. 3, 1999. Priority is claimed on that application and on the following application:

Country: Germany, Application No.: 198 15 154.3, Filed: Mar. 27, 1998.

BACKGROUND OF THE INVENTION

1. Field of the Invention

The invention relates to a base of a metallurgical vessel having a direct-current arc device whose cathode projects into the vessel and in whose fire-resistant lining on the base at least one anode is arranged, one end of which, passing through the vessel wall, touches metallic melt located in the vessel, and the other end of which can be connected to cooling fluid supply sources and is attached in an electrically insulated manner to the vessel wall via holding elements.

2. Discussion of the Prior Art

DE 40 26 897 A1 discloses a metallurgical vessel having a vessel base which has a fire-resistant lining in which the base electrode of a direct-current arc furnace is arranged. A holding device is detachably attached to the casing of the vessel, isolated by insulation. The holding device in this case comprises a flanged tube which is arranged coaxially with respect to the electrode center and can be screwed to the metallurgical vessel.

The electrode, which passes through the furnace wall, makes contact with the melt located in the vessel. During operation, the head area of the electrode is melted. Since this is the lowest point in the furnace vessel, at which the melt is located, the thinner liquid and heavier melt components also gather here. Defects in the fire-resistant material can lead to connections of the liquid thread between the electrode and the metal casing of the vessel. This causes damage or destruction to the furnace vessel in the region of the base electrode, due to electrical flashovers.

SUMMARY OF THE INVENTION

The invention is based on the aim of providing a base of a metallurgical vessel having a direct-current arc device, in which the occurrence of electrical flashovers in the vessel base is prevented by simple design means.

According to the invention, the passage of the anode through the metallic base of the furnace vessel is designed as an outlet channel. For this purpose, a sleeve is provided which sheaths that part of the anode which projects into the vessel and in the process is placed at a distance sufficiently far away from the anode that low melting-point metals can flow out of the vessel without being impeded. The sleeve is in this case formed from a material which does not conduct electric current, preferably from ceramic.

The head of the sleeve, which faces the vessel interior, is designed as a collecting screen, and in this case has a conically diverging shape. In one advantageous refinement, the sleeve comprises at least two parts, with the first part having a cylindrical shape and the second part having a conically opening funnel shape away from a separation point in the direction of the vessel interior.

In a further advantageous embodiment, a sleeve which is composed of a fire-resistant ramming mass and extends in an extension of the funnel-shaped second part of the sleeve is provided in the fire-resistant lining. The sleeve formed from the ramming mass in this case provides the function of drainage and ensures that all the thin-liquid metal is passed to the sleeve even when the wear of the anode is relatively severe.

The distance $\Delta r$ of the outlet channel between the anode and the tubular holding element of the anode and the sleeve is 0.5 to 2 mm. This distance is sufficient to prevent the normal melt from flowing out of the vessel base.

A collecting apparatus is arranged underneath the base, in order to collect the thin-liquid metal, such as lead, flowing out via the outlet channel.

In one particularly simple construction in design terms, the anode is held by a clamping ring which is separated via insulation and is arranged underneath the furnace base. The insulation is held in a positively locking manner as a simple ring by the furnace base and, in the process, is at a distance from the anode forming an outlet channel.

Figure 1:
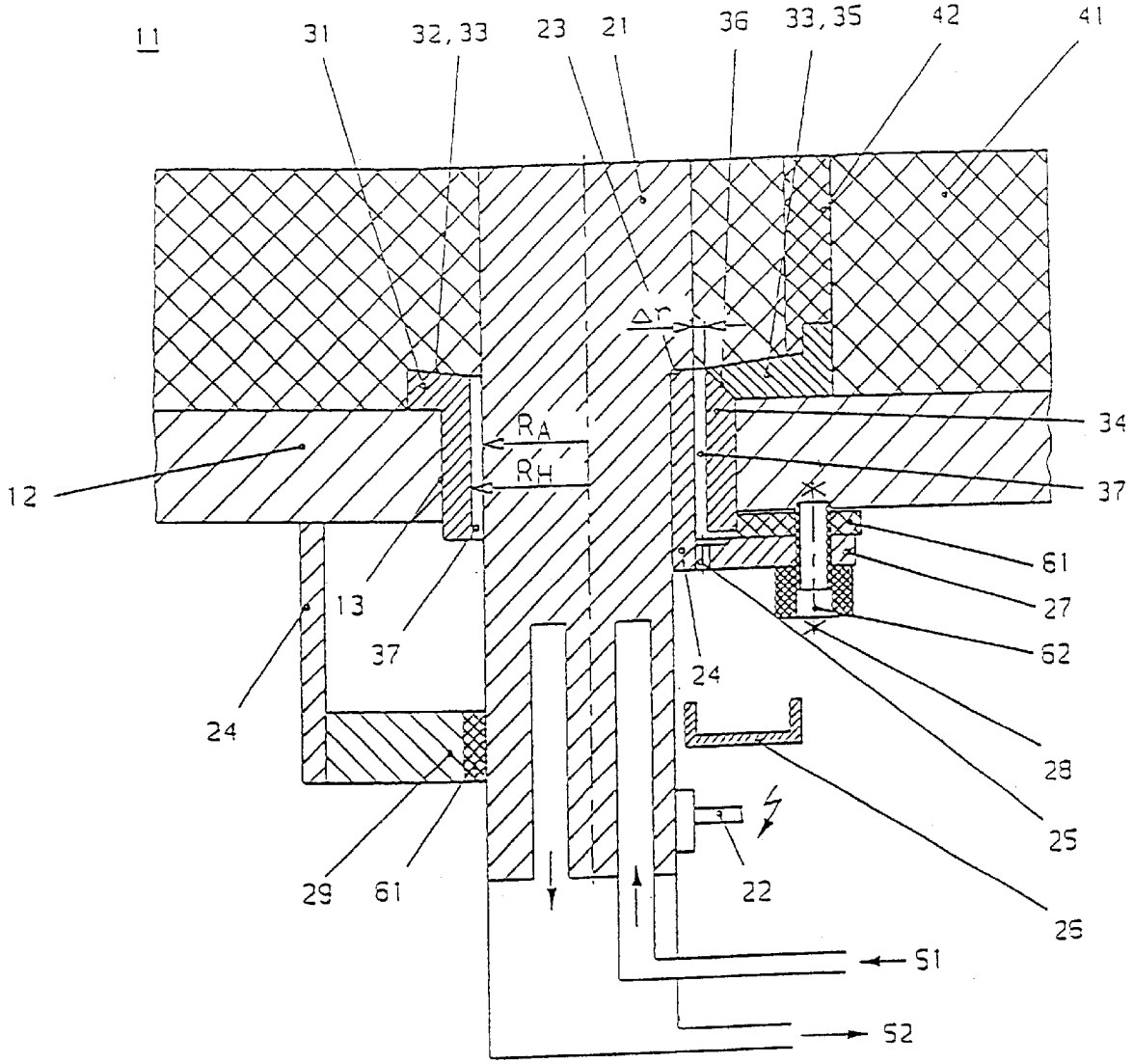
FIG. 1 shows a section of the invention.

An opening 13 is provided in the metallic base 12 of a vessel pursuant to the metallurgical vessel 11, which is not illustrated in any more detail, through which opening 13 an anode 21 is passed.

DETAILED DESCRIPTION OF THE PREFERRED EMBODIMENTS

The anode 21 in this case passes through the fire-resistant lining 41 to a sufficient extent that it makes contact with the melt with which the vessel 11 can be filled.

In the left-hand part of the drawing, the anode 21 is held by a holding element 24 which has a clamping ring 29 by means of which the anode 21 is separated, and thereby held, by an insulating spacer 61.

In the right-hand part of the FIG. 1, the anode 21 has a step 23 which corresponds to a holding element 24 which is of tubular design and has a flange 27 which is attached via retaining screws 28 to the vessel base 12. The flange 27 is electrically non-conductively connected to the metallic part of the metallurgical vessel 11 by means of an insulating spacer 61 and screw insulation 62.

The anode 21 is water-cooled and has a coolant supply 51 and a coolant return 52. Furthermore, it is electrically connected to an electrical connection 22.

Where it passes 13 through the base 12 of the metallurgical vessel 11, the anode 21 is surrounded by a sleeve 31. This sleeve 31 is formed from material which does which is at a distance $\Delta R$ of 0.5 to 2 mm from the other radius $R_A$ of the anode or of the holding element 24 which holds the anode, at. Thin-liquid metal can flow out of the metallurgical vessel via the annular outlet channel 37 and, in the right-hand part of FIG. 1, through opening 25 in the holding element 24 and into a collecting device 26.

In the left-hand part of FIG. 1, the sleeve 31 is of integral construction and is held in a positively locking manner by the base 12. The sleeve has a sleeve head 32 that faces the interior of the vessel and diverges conically to form a collecting screen 33

In the right-hand part of FIG. 1, the sleeve 31 is formed from two pieces and has a first part 34 with a cylindrical shape and a second part 35 which is in the form of a funnel. The parts 34, 35 meet at a separation point 36.

The extension of the head of the funnel-shaped part 35 is formed by a fire-resistant ramming mass 42, which is formed in the metallurgical vessel 11 as drainage, in the form of a sleeve, in the fire-resistant lining 41 of the base 12.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A base of a metallurgical vessel having a direct-current arc device with a cathode that projects into the vessel and a fire-resistant lining on the base in which at least one anode is arranged, one end of the anode passing through the vessel wall and touching metallic melt located in the vessel, and another end of the anode is connectable to cooling fluid supply sources and is attached in an electrically insulated manner to the vessel wall via holding elements, the base comprising a sleeve, which does not conduct electric current, provided so as to sheath a part of the anode which projects into the metallurgical vessel and form an outlet channel, the sleeve being arranged at a distance ($\Delta_r$) sufficiently far away from the anode so that low-melting-point metals can flow out of the vessel without being impeded, the distance $\Delta r$ being $\Delta r = R_H - R_A = 0.5$ to 2 mm where $R_H$=internal radius of the sleeve; and $R_A$=external radius of the anode and the holding element holding the anode.

2. A base of a metallurgical vessel as defined in claim 1, wherein the sleeve has a head which faces an interior of the vessel and diverges conically so as to form a collecting screen.

3. A base of a metallurgical vessel as defined in claim 1, wherein the sleeve comprises at least two parts including a first part having a cylindrical shape, and a second part having a conically opening funnel shape away from a separation point between the first part and the second part.

4. A base of a metallurgical vessel as defined in claim 3, and further comprising a ramming mass arranged above a mouth of the funnel-shaped second part of the sleeve.

5. A base of a metallurgical vessel as defined in claim 1, and further comprising a tubular holding element having a flange, and retaining screws arranged to attach the flange to the base so that the tubular holding element forms a support for the anode.

6. A base of a metallurgical vessel as defined in claim 5, wherein the outlet channel has a mouth connected to openings in the flange of the holding element for the anode, via which liquid, low melting-point metal passes out of the metallurgical vessel so as to be collectable in a collecting apparatus.

7. A base of a metallurgical vessel as defined in claim 1, and further comprising an insulating spacer and a clamping ring firmly connected to the base of the vessel via the insulating spacer so as to hold the anode.

8. A base of a metallurgical vessel as defined in claim 1, wherein the sleeve is composed of a ceramic.

* * * * *